US006375709B1

(12) United States Patent
Storström et al.

(10) Patent No.: US 6,375,709 B1
(45) Date of Patent: Apr. 23, 2002

(54) LUBRICANT FOR METALLURGICAL POWDER COMPOSITIONS

(75) Inventors: Helge Storström, Lorgues (FR); Hilmar Vidarsson, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/533,945

(22) Filed: Mar. 23, 2000

Related U.S. Application Data

(63) Continuation of application No. PCT/SE98/02179, filed on Dec. 1, 1998.

(30) Foreign Application Priority Data

Dec. 2, 1997 (SE) ..... 9704494

(51) Int. Cl.[7] ..... B22F 1/00; B22F 3/12

(52) U.S. Cl. ..... 75/252; 419/31; 419/32; 419/37; 419/38

(58) Field of Search ..... 75/252; 419/31, 419/32, 37, 38; 524/227, 394, 398

(56) References Cited

U.S. PATENT DOCUMENTS

| | | | | | |
|---|---|---|---|---|---|
| 4,483,905 | A | | 11/1984 | Engström | 428/570 |
| 4,676,831 | A | | 6/1987 | Engström | 75/252 |
| 4,803,235 | A | * | 2/1989 | Okada | 524/494 |
| 4,834,800 | A | | 5/1989 | Semel | 106/403 |
| 5,063,011 | A | | 11/1991 | Rutz et al. | 264/126 |
| 5,108,493 | A | | 4/1992 | Causton | 75/25 |
| 5,198,137 | A | | 3/1993 | Rutz et al. | 252/62.54 |
| 5,256,185 | A | * | 10/1993 | Semel et al. | 75/25 |
| 5,368,630 | A | | 11/1994 | Luk | 75/252 |
| 5,432,223 | A | | 7/1995 | Champagne et al. | 524/431 |
| 5,714,567 | A | * | 2/1998 | Idage et al. | 528/180 |

FOREIGN PATENT DOCUMENTS

| | | |
|---|---|---|
| EP | 0300039 A1 | 1/1989 |
| EP | 0531819 A1 | 3/1993 |
| WO | WO95/00636 | 1/1995 |

* cited by examiner

*Primary Examiner*—Ngoclan Mai
(74) *Attorney, Agent, or Firm*—Burns, Doane, Swecker & Mathis, L.L.P.

(57) ABSTRACT

This invention concerns a lubricant for warm compaction of iron-based metallurgical powder compositions. 50 to 100% by weight of the lubricant is a polyester, aromatic or partly aromatic, which has a number-average molecular weight $M_n$ of 5,000–50,000. This invention further concerns a metal powder composition containing the lubricant, a method for making sintered products by using the lubricant, and use of the same in warm compaction of metallurgical powders.

14 Claims, No Drawings

LUBRICANT FOR METALLURGICAL POWDER COMPOSITIONS

This is a continuation of International Application No. PCT/SE98/02179, filed Dec. 1, 1998, that designates the United States of America and which claims priority from Swedish Application No. 9704494-5, filed Dec. 2, 1997.

This invention relates to a lubricant for iron-based metallurgical powder compositions, as well as metal power compositions containing the lubricant. The invention further concerns a method for making sintered products by using the lubricant, as well as use of the lubricant in a metal powder composition in warm compaction. By using the lubricant according to the invention, high green strength may be obtained.

In industry, the use of metal products manufactured by compacting and sintering metal powder compositions is becoming increasingly widespread. A number of different products of varying shape and thickness are being produced, and the quality requirements placed on these products are that the manufactured metal products have high density as well as high strength.

In metal compaction, different standard temperature ranges are used. Both cold pressing and warm pressing require the use of a lubricant.

Compaction at temperatures above room temperature has evident advantages, yielding a product of higher density and higher strength than compaction performed at lower temperatures.

Most of the lubricants used in cold compaction cannot be used in high-temperature compaction since they seem to be effective within a limited temperature range only. An ineffective lubricant considerably increases the wear on the compacting tool.

The degree of wear on the tool is influenced by various factors, such as the hardness of the material of the tool, the pressure applied, and the friction between the compact and the wall of the tool when the compact is ejected. The latter factor is strongly linked to the lubricant used.

The ejection force is the force required for ejecting the compact from the tool. Since a high ejection force not only increases wear on the compacting tool but also may damage the compact, this force should preferably be reduced.

However, the use of a lubricant may create problems in compaction, and it is therefore important that the lubricant is well suited to the type of compaction carried out.

In order to perform satisfactorily, the lubricant should be forced out of the pore structure of the powder composition in the compacting operation, and into the interspace between the compact and the tool, thereby lubricating the walls of the compaction tool. By such lubrication of the walls of the compaction tool, the ejection force is reduced.

Another reason why the lubricant has to emerge from the compact is that it would otherwise create pores in the compact after sintering. It is well-known that large pores have an adverse effect on the dynamic strength properties of the product.

An object of the new lubricant according to the present invention is to make it possible to manufacture compacted products having high green strength, high green density as well as sintered products having high sintered density and low ejecting force from the lubricant in combination with metal powders. As the compact is subject to considerable stress when ejected from the compacting tool and as the product must maintain its integrity during the handling between compaction and sintering without cracking or being otherwise damaged, it is important to have high green strength. This is especially important in the case of thin parts.

The lubricant according to the invention contains a polyester, which is a polymer formed by e.g. the esterification condensation of di-functional alcohols and acids. Polyesters are available as resins and thermoplastics, and are subdivided into aliphatic and aromatic polyesters, mainly depending on the type of acid monomer used. Aromatic polyesters are usually non-hygroscopic, aliphatic polyesters are, however, known to be more sensitive to moisture. Polyesters can be further classified into saturated and unsaturated polyesters, depending on whether double bonds are present in the polymer backbone. While saturated polyesters are relatively unreactive, unsaturated polyesters are suitable as resins by copolymerisation with other monomers, such as styrenes, diallyl phthalates, etc.

The polyester according to the invention is a saturated polyester, aromatic or partly aromatic, which has a number-average molecular weight Mn of 5000–50000, and 50–100% by weight, preferably 60–100% by weight and most preferred 70–100% by weight of the lubricant is made up of this polyester. Apart from the polyester, the lubricant according to the invention, may contain other PM-lubricants, such as zinc stearate, lithium stearate and/or lubricants of amide wax type, such as ethylene bis-stearamid. A preferred lubricant according to the invention contains 0–30% by weight of zinc stearate, 0–30% by weight of lithium stearate, and/or 0–30% by weight of a lubricant of amide wax type, the balance being polyester.

The polyester is preferably a polymer or a copolymer of alkylene phthalate, wherein alkylene phthalate is a $C_2$–$C_8$-alkylene phthalate, whereby the polyester preferably has a melting point peak above 100° C.

Most preferred, the polyester is a poly(alkylene terephthalate) or a poly(alkylene isophthalate).

The invention further concerns a metal powder composition containing a metal powder and a lubricant according to the invention. This metal powder composition can be used for warm compaction.

The metal powder composition according to the invention comprises 0.1 to 2% by weight of the lubricant according to the invention, 0.005–3% by weight of binding agent, 0–0.5% by weight of plastiziser, 0.01–3% by weight of graphite, 0–2% by weight of thermoplastics, 0–15% by weight, preferably 0–7% by weight of alloying elements, 0 to 2% by weight of processing aids, and 0 to 2% by weight of hard phases, the balance being iron powder selected from the group consisting of essentially pure iron powders, partially prealloyed iron powders and prealloyed iron powders.

The lubricant preferably makes up 0.2–0.8% by weight of the metal powder composition according to the invention, based on the total amount of the metal powder composition. The possibility of using the lubricant according to the present invention in small amounts is an especially advantageous feature of the invention since it permits compacts and sintered products having high densities to be achieved cost-effectively.

As used in the description and the appended claims, the expression "partly aromatic" encompasses a polyester in which some of the aromatic dicarboxylic acids have been replaced by aliphatic dicarboxylic acids in order to modify the temperature dependence/melt behaviour (rheology) of the resulting polyester.

As used in the description and the appended claims, the expression "metal powder" encompasses iron-based powders essentially made up of iron powders containing not more than about 1.0% by weight, preferably not more than about 0.5% by weight, of normal impurities. Examples of such highly compressible, metallurgical-grade iron powders are the ANCORSTEEL 1000 series of pure iron powders, e.g. 1000, 1000B and 1000C, available from Hoeganaes Corporation, Riverton, N.J. and similar powders available from Höganäs AB, Sweden. For example, ANCORSTEEL 1000 iron powder, has a typical screen profile of about 22% by weight of the particles below a No. 325 sieve (U.S. series) and about 10% by weight of the particles larger than a No. 100 sieve, the remainder being between these two sizes (trace amounts larger than No. 60 sieve). The ANCORSTEEL 1000 powder has an apparent density of about 2.85–3.00 g/cm$^3$, typically 2.94 g/cm$^3$. Other iron powders that can be used in the invention are typical sponge iron powders, such a Hoeganaes' ANCOR MH-100 powder.

The iron-based powders can also include iron, preferably substantially pure iron, that has been prealloyed, diffusion bonded, or admixed with one or more alloying elements. Examples of alloying elements that can be combined with the iron particles include, but are not limited to, molybdenum; manganese; magnesium; chromium; silicon; copper; nickel; gold; vanadium; columbium (niobium); graphite; phosphorus; aluminium; binary alloys of copper and tin or phosphorus; Ferro-alloys of manganese, chromium, boron, phosphorus, or silicon; low melting ternary and quaternary eutectics of carbon and two or three of iron, vanadium, manganese, chromium, and molybdenum; carbides of tungsten or silicon; silicon nitride; aluminium oxide; and sulphides of manganese or molybdenum, and combinations thereof. Typically, the alloying elements are generally combined with the iron powder, preferably the substantially pure iron powder in an amount of up to about 7% by weight, more preferably from about 0.25% to about 5% by weight, most preferably from about 0.25% to about 4% by weight, although in certain specialised uses, such as for manufacturing of stainless steel, the alloying elements may be present in an amount of from about 7% to about 15% by weight, of the iron powder and alloying element.

The iron-based powders can thus include iron particles that are in admixture with the alloying elements that are in the form of alloying powders. The term "alloying powder" as used herein refers to any particulate element or compound, as previously mentioned, physically blended with the iron particles, whether or not that element or compound ultimately alloys with the iron powder. The alloying-element particles generally have a weight average particle size below about 100 microns, preferably below about 75 microns, more preferably below about 30 microns. Binding agents are preferably included in admixtures of iron particles and alloying powders to prevent dusting and segregation of the alloying powder from the iron powder. Examples of commonly used binding agents include those set forth in U.S. Pat. Nos. 4,483,905 and 4,676,831, both to Engström, and in U.S. Pat. No. 4,834,800 to Semel, all of which are incorporated by reference herein in their entirety.

The iron-based powder can further be in the form of iron that has been pre-alloyed with one or more of the alloying elements. The pre-alloyed powders can be prepared by making a melt of iron and the desired alloying elements, and then atomising the melt, whereby the atomised droplets form the powder upon solidification. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders is diffusion-bonded iron-based powder, which contains particles of substantially pure iron that have the alloying elements set forth above diffusion-bonded to their outer surface. Such commercially available powders include DISTALOY 4600A diffusion-bonded powder available from Hoeganaes Corporation, which contains about 1.8% nickel, about 0.55% molybdenum, and about 1.6% copper, and DISTALOY 4800A diffusion bonded powder available from Hoeganaes Corporation, which contains about 4.05% nickel, about 0.55% molybdenum, and about 1.6% copper. Similar grade powders are also available from Höganäs AB, Sweden.

A preferred iron-based powder is made of iron pre-alloyed with molybdenum (Mo). The powder is produced by atomising a melt of substantially Dure iron containing from about 0.5% to about 2.5% by weight of Mo. An example of such a powder is Hoeganaes ANCORSTEEL 85HP steel powder, which contains about 0.85% by weight of Mo, less than about 0.4% by weight, in total, of such other materials as manganese, chromium, silicon, copper, nickel, molybdenum or aluminium, and less than about 0.02% by weight of carbon. Another example of such a powder is Hoeganaes ANCORSTEEL 4600V steel powder, which contains about 0.5–0.6% by weight of molybdenum, about 1.5–2.0% by weight of nickel, and about 0.1–0.25% by weight of manganese, and less than about 0.02% by weight of carbon.

Another pre-alloyed iron-based powder that can be used in the invention is disclosed in U.S. Pat. No. 5,108,493 to Causton, entitled "Steel Powder Admixture Having Distinct Pre-alloyed Powder of Iron Alloys", which is herein incorporated in its entirety. This steel powder composition is an admixture of two different pre-alloyed iron-based powders, one being a pre-alloy of iron with 0.5–2.5% by weight of molybdenum, the other being a pre-alloy of iron with carbon and with at least about 25% by weight of a transition element component, wherein this component comprises at least one element selected from the group consisting of chromium, manganese, vanadium, and columbium. The admixture is in proportions that provide at least about 0.05% by weight of the transition element component to the steel powder composition. An example of such a powder is commercially available as Hoeganaes ANCORSTEEL 41 AB steel powder, which contains about 0.85% by weight of molybdenum, about 1% by weight of nickel, about 0.9% by weight of manganese, about 0.75% by weight of chromium, and about 0.5% by weight of carbon.

Other iron-based powders that are useful in the practice of the invention are ferromagnetic powders. An example is a composition of substantially pure iron powders in admixture with powder of iron that has been pre-alloyed with small amounts of phosphorus.

Still further iron-based powders that are useful in the practice of the invention are iron particles coated with a thermoplastic material to provide a substantially uniform coating of the thermoplastic material as described in U.S. Pat. No. 5,198,137 to Rutz et al., which is incorporated herein in its entirety. Preferably, each particle has a substantially uniform circumferential coating about the iron core particle. Sufficient thermoplastic material issued to provide a coating of about 0.001–15% by weight of the iron particles as coated. Generally the thermoplastic material is present in an amount of at least 0.2% by weight, preferably about 0.4–2% by weight, and more preferably about 0.6–0.9% by weight of the coated particles. Preferred are thermoplastics such as polyethersulfones, polyetherimides, polycarbonates, or polyphenylene ethers, having a weight average molecular weight in the range of about 10000 to 50000. Other polymeric coated iron-based powders include those containing an inner coating of iron phosphate as set forth in U.S. Pat. No. 5,063,011 to Rutz et al., which is incorporated herein in its entirety.

The particles of pure iron, pre-alloyed iron, diffusion-bonded iron, or thermoplastic coated iron can have a weight average particle size as small as 1 μm or below, or up to about 850–1000 μm, but generally the particles will have a weight average particle size in the range of about 10–500 μm. Preferred are those having a maximum number average particle size up to about 350 μm, preferably 50–150 μm.

Apart from the metal powder and the lubricant according to the invention, the metal-powder composition may contain, as stated above, one or more additives selected. from the group consisting of binders, processing aids and hard phases.

The binder may be added to the powder composition in accordance with the method described in U.S. Pat. No. 4,834,800 (which is hereby incorporated by reference) and be blended into the metal-powder compositions in amounts of about 0.005–3% by weight, preferably about 0.05–1.5% by weight, and more preferably about 0.1–1% by weight, based on the weight of the iron and alloying powders, and may consist of e.g. cellulose ester resins, hydroxyalkyl cellulose resins having 1–4 carbon atoms in the alkyl group, or thermoplastic phenolic resins.

The binding agents described in U.S. Pat. No. 5,368,630 are polymeric resin materials that can be either soluble or insoluble in water, although it is preferred that the resin is insoluble in water. Preferably, the resin will have the capacity to form a film, in either its natural liquid state or as dissolved in a solvent, around the iron-based powder and the alloying powder. It is important that the binding agent resin is selected such that it will not adversely affect the elevated temperature compaction process. Preferred binding agents include cellulose ester resins such as cellulose acetates having a number average molecular weight (MW) of from about 30,000–70,000, cellulose acetate butyrates having a Mw of from about 10,000–100,000, cellulose acetate propionates having a Mw of from about 10,000–100,000 and mixtures thereof. Also useful are high molecular weight thermoplastic phenoloic resins having a MW of from about 10,000–80,000, and hydroxyalkylcellulose resins wherein the alkyl moiety has from 1–4 carbon atoms having a Mw of from about 50,000–1,200,000, and mixtures thereof. Another preferred binding agent is polyvinylpyrrolidone that is preferably used in combination with the plastizicers such as PEG, glycerol and its esters, esters of organic diacids, sorbitol, phosphate esters, cellusose esters, arylsufonamide-formaldehyde resins and long chain alcohols as disclosed in the U.S. Pat. No. 5,432,223.

The processing aids used in the metal powder composition may consist of talc, forsterite, manganese sulphide, sulphur, molybdenum disulphide, boron nitride tellurium, selenium, barium difluoride and calcium difluoride, which are used either separately or in combination.

The hard phases used in the metal powder composition may consist of carbides of tungsten, vanadium, titanium, niobium, chromium, molybdenum, tantalum and zirconium, nitrides of aluminium, titanium, vanadium, molybdenum and chromium, $Al_2O_3$, $B_4C$, and various ceramic materials.

With the aid of conventional techniques, the metal-powder and the lubricant particles are mixed to a substantially homogeneous powder composition.

Preferably, the lubricant according to the invention is added to the metal powder composition in the form of solid particles. The average particle size of the lubricant may vary, but preferably is in the range of 3–100 μm.

If the particle size is too large, it becomes difficult for the lubricant to leave the pore structure of the metal powder composition during compaction and the lubricant may then give rise to large pores after sintering, resulting in a compact showing impaired strength properties.

If the lubricant, in addition to the polyester, contains zinc stearate, lithium stearate and/or lubricants of amide wax type, the ingredients of the lubricant composition can be added separately or as a single-phase lubricant. As used in the description, the expression "a single-phase lubricant" encompasses a lubricant composition, where the different ingredients have been melted together to create uniform lubricant particles, where substantially all the ingredients are present in each lubricant particle.

The invention further concerns a method for making sintered products, wherein the following steps are included:

a) mixing a metal powder, a lubricant according to the invention and optional additives to a metal powder composition, b) preheating the metal powder composition to a predetermined temperature, c) compacting the heated metal powder composition in a preheated tool to a compacted body, and d) sintering the compacted body.

The metal powder composition in step b) is preferably preheated to a temperature below the melting point peak of the polyester, and the tool before step c) is preferably preheated to a temperature of the melting point peak of the polyester or below. Most preferably the metal powder composition is preheated to a temperature of 90–130° C. and the tool is preheated to a temperature of 110–140° C. The compacted body is preferably sintered for 15–60 min at a temperature of 1100–1250° C.

In warm compaction according to the invention, the metal powder composition is, as stated above, preferably preheated before being supplied to the preheated compaction tool. In such preheating of the metal powder composition, it is of importance that the lubricant does not soften or melt, which would make the powder composition difficult to handle when filling the compaction tool, which in turn would result in a compacted body having a non-uniform density and poor reproducibility of part weights.

A few tests will now be accounted for in order to illustrate that the invention is effective and yields products of high green density as well as high green strength.

Test 1

Table 1 below states a number of lubricants by indicating powder temperature (° C.), tool temperature (° C.), compaction pressure (Comp. Press, MPa), green density (GD, g/cm$^2$) and ejection force (Ej.F, N/mm$^2$).

The metal powder compositions contained the following ingredients:

Distaloy® AE, marketed by Höganäs AB 0.3% by weight of graphite 0.6% by weight of lubricants according to Table 1

The metal powder composition was mixed in a Lödige mixer.

TABLE 1

Lubricants in warm compaction

| Lubricant | Powder temp ° C. | Tool temp ° C. | Comp Press MPa | GD g/cm$^2$ | Ej. F N/mm$^2$ |
|---|---|---|---|---|---|
| WCE 34 | 125 | 150 | 600 | 7.34 | 10.1 |
| WCE 34 | 125 | 150 | 800 | 7.44 | 12.3 |
| WCS 4 | 100 | 120 | 600 | 7.32 | 16.9 |
| WCS 4 | 100 | 120 | 800 | 7.46 | 16.8 |

TABLE 1-continued

Lubricants in warm compaction

| Lubricant | Powder temp ° C. | Tool temp ° C. | Comp Press MPa | GD g/cm$^2$ | Ej. F N/mm$^2$ |
|---|---|---|---|---|---|
| WCS 4 + H-WAX | 110 | 120 | 700 | 7.40 | — |
| WCS 5 | 100 | 120 | 600 | 7.32 | 15.9 |
| WCS 5 | 100 | 120 | 800 | 7.47 | 17.6 |
| Lubricant X1 | 150 | 150 | 600 | 7.16 | 13.1 |

WCE 34 is a lubricant according to the invention and has a number-average molecular weight $M_n$ of approximately 10000–20000, is a polyester, partly aromatic with terephthalic acid as most represented acid, melting point peak in the range of 150 to 160° C., melting viscosity of 700 Ps (160° C., load 2.16 kg, method ISO 1133), and Tg of 10° C.

WCS 4 is a lubricant according to the invention and has a number-average molecular weight $M_n$ of 20000 and is a poly(hexylene terephthalate).

WCS 4+H-WAX, is a lubricant according to the invention and is a mixture of 75% by weight of WCS 4, as above, and 25% by weight of H-WAX, which is a ethylene bis-stearamid wax.

WCS 5 is a lubricant according to the invention and has a number-average molecular weight $M_n$ of 40000 and is a poly(hexylene terephthalate).

Lubricant X1 is a lubricant according to PCT/SE95/00636, which essentially consists of an oligomer of amide type with a weight-average molecular weight, $M_w$, of 18000, and this lubricant is outside the scope of the invention.

The green density was measured according to ISO 3927 1985, and the ejection force was measured according to H öganäs Method 404.

As appears from Table 1, higher green densities can be attained with the lubricants according to the invention than with lubricant X1, while the ejection forces vary and in some cases are lower than with lubricant X1 and in some cases higher, but are still within an acceptable range.

Compared to the material containing lubricant X1, the materials admixed with lubricants according to the invention give comparable green density (GD) and ejection forces (Ej.F) after compaction. The lubricants according to the invention thus constitute equally good lubricants as lubricant X1.

What is claimed is:

1. A metal powder composition for warm compaction containing metal powder and a lubricant, wherein 50 to 100% by weight of the lubricant is an aromatic or partly aromatic polyester having a number-average molecular weight Mn of 5,000 to 50,000, and wherein the metal powder composition comprises 0.1 to 2% by weight of the lubricant, 0.005 to 3% by weight of binding agent, 0 to 0.5% by weight of plasticizer, 0.01 to 3% by weight of graphite, 0 to 2% by weight of thermoplastics, 0 to 15% by weight of alloying elements, 0 to 2% by weight of processing aids, and 0 to 2% by weight of hard phases, the balance being iron powder selected from the group consisting of essentially pure iron powder, partially prealloyed iron powder, and prealloyed iron powder.

2. A metal powder composition according to claim 1, comprising greater than zero to 0.7% by weight of alloying elements.

3. A metal powder composition according to claim 1, wherein the lubricant contains an amount greater than zero to 40% by weight of at least one PM-lubricant.

4. A metal powder composition according to claim 3 wherein said at least one PM-lubricant is selected from the group consisting of zinc stearate, lithium stearate, and lubricants of amide wax.

5. A metal powder composition according to claim 3, wherein the lubricant contains 0 to 30% by weight of lithium stearate, and 0 to 30% by weight of amide wax, with the balance being said polyester.

6. A metal powder composition according to claim 1, wherein the polyester is a polymer or a copolymer of alkylene terephthalate, wherein the alkylene phthalate is a $C_2$ to $C_8$ alkylene phthalate.

7. A metal powder composition according to claim 1, wherein the polyester has a melting point peak above 100° C.

8. A metal powder composition as claimed in claim 1, wherein the lubricant makes up 0. 2 to 0.8% by weight of the composition.

9. A method for making sintered products, comprising the steps of a) mixing a metal powder composition according to claim 1, b) preheating the metal powder composition to a predetermined temperature, c) compacting the heated metal powder composition to a compacted body in a preheated tool, and d) sintering the compacted body.

10. A method as claimed in 9, wherein the metal powder composition in step b) is preheated to a temperature below the melting point peak of the polyester.

11. A method as claimed in claim 10, wherein the metal powder composition is preheated to a temperature of 90 to 130° C.

12. A method as claimed in claim 9, wherein the tool before step c) is heated to a temperature of the melting point peak of the polyester or below.

13. A method as claimed in claim 12, wherein the tool is preheated to a temperature of 110 to 140° C.

14. A method as claimed in claim 9, wherein the compacted body is sintered at a temperature of 1100 to 1250° C. during 15 to 60 minutes.

* * * * *